US009418578B2

(12) United States Patent
Hattori

(10) Patent No.: US 9,418,578 B2
(45) Date of Patent: Aug. 16, 2016

(54) SIGNBOARD DEVICE

(71) Applicant: Takahiro Hattori, Tokyo (JP)

(72) Inventor: Takahiro Hattori, Tokyo (JP)

( * ) Notice: Subject to any disclaimer, the term of this patent is extended or adjusted under 35 U.S.C. 154(b) by 0 days.

(21) Appl. No.: 14/783,425

(22) PCT Filed: Apr. 8, 2014

(86) PCT No.: PCT/JP2014/060562

§ 371 (c)(1),
(2) Date: Oct. 8, 2015

(87) PCT Pub. No.: WO2014/168254

PCT Pub. Date: Oct. 16, 2014

(65) Prior Publication Data

US 2016/0078789 A1 Mar. 17, 2016

(30) Foreign Application Priority Data

Apr. 9, 2013 (JP) ..... 2013-081165

(51) Int. Cl.

| | |
|---|---|
| ***G09F 9/00*** | (2006.01) |
| ***G09F 13/04*** | (2006.01) |
| ***G09F 9/302*** | (2006.01) |
| ***G09F 9/35*** | (2006.01) |

(Continued)

(52) U.S. Cl.

CPC *G09F 13/04* (2013.01); *G09F 9/30* (2013.01); *G09F 9/3026* (2013.01); *G09F 9/35* (2013.01); *G09F 19/08* (2013.01); *G09F 2019/081* (2013.01)

(58) Field of Classification Search

CPC ..... G09F 13/04; G09F 9/40; G09F 13/18; G09F 9/00; G09F 9/33; G09F 9/35

USPC ..... 362/249.02; 345/1.3, 31, 33, 35, 55; 40/442, 502, 564, 573, 714

See application file for complete search history.

(56) References Cited

U.S. PATENT DOCUMENTS 6,178,674 B1 * 1/2001 Decaux ..... G09F 11/21 40/467

(Continued)

FOREIGN PATENT DOCUMENTS

JP 61-195075 U 12/1986
JP 2-21684 U 2/1990

(Continued)

OTHER PUBLICATIONS

International Search Report mailed Jul. 8, 2014, corresponding to International application No. PCT/JP2014/060562.

*Primary Examiner* — Cassandra Davis
(74) *Attorney, Agent, or Firm* — Hauptman Ham, LLP

(57) ABSTRACT

A signboard device is configured by combining a dynamic-image block for displaying a dynamic image and a plurality of light-source blocks each provided with a light source emitting light forward. The signboard device is configured so that, when seen along a front-rear direction, the length from the top edge to the bottom edge of each of the light-source blocks is the same as or n times or 1/n times (n being an integer) the length from the top edge to the bottom edge of the dynamic-image block, and the length from the left edge to the right edge of each of the light-source blocks is the same as or m times or 1/m times (m being an integer) the length from the left edge to the right edge of the dynamic-image block.

4 Claims, 8 Drawing Sheets

(51) Int. Cl.
*G09F 19/08* (2006.01)
*G09F 9/30* (2006.01)

(56) References Cited

U.S. PATENT DOCUMENTS

| | | | | |
|---|---|---|---|---|
| 9,285,533 | B2 * | 3/2016 | Moriwaki | G02F 1/13336 |
| 2004/0233220 | A1 | 11/2004 | Decaux et al. | |
| 2013/0279177 | A1 | 10/2013 | Moriwaki et al. | |

FOREIGN PATENT DOCUMENTS

| | | | | | |
|---|---|---|---|---|---|
| JP | 2004-348107 | A | | 12/2004 | |
| JP | 2005-37630 | A | | 2/2005 | |
| JP | 2010-113163 | A | | 5/2010 | |
| JP | 2010113163 | A | * | 5/2010 | G09F 13/04 |
| JP | 2012-168235 | A | | 9/2012 | |
| JP | WO 2013122170 | A1 | * | 8/2013 | G09F 9/30 |
| JP | 2015121759 | A | * | 7/2015 | G09F 13/04 |
| WO | 2012/096231 | A1 | | 7/2012 | |

* cited by examiner

SIGNBOARD DEVICE

RELATED APPLICATIONS

The present application is a National Phase of International Application Number PCT/JP2014/060562, filed Apr. 8, 2014, and claims priority of Japanese Patent Application No. 2013-081165 filed on Apr. 9, 2013.

TECHNICAL FIELD

This invention relates to a signboard device, in particular, the invention relates to a signboard device configured by combining a plurality of blocks.

BACKGROUND ART

JP-A 2012-168235 discloses the signboard device which increases attraction to an advertisement with an eyecatch effect. The disclosed signboard device has a dynamic-image portion inside the advertisement. The signboard device disclosed in JP-A 2012-168235 comprises an LCD (Liquid Crystal Display) and the light guiding member covering the entire front surface of the LCD. The light guiding member removes the shadow of a frame of the LCD so that the dynamic-image portion and the other portion are seen in an integrated manner.

JP-A 2010-113163 proposes a backlight device which comprises a plurality of light source blocks.

CITATION LIST

Patent Literature

[Patent Literature 1] JP-A 2012-168235
[Patent Literature 2] JP-A 2010-113163

SUMMARY OF INVENTION

Technical Problem

When arranging the LCD of JP-A 2012-168235 inside the signboard device, a support member supporting the LCD is needed. The shadow of the support member may fall on the front surface of the signboard device. When arranging a large LCD, a large support member is needed. Thus, the large shadow may fall on the front surface of the signboard device.

The purpose of the present invention is to provide a signboard device which can solve the problem of the shadow and deal with any size of the signboard device.

Solution to Problem

One aspect of the present invention provides a signboard device comprising a plurality of light-source blocks and a dynamic-image block. The light-source block comprises the light source emitting light forward. The dynamic-image block comprises a display device and a light-emitting portion. The display device comprises a display portion and a housing holding the display portion. The display portion displays a dynamic image. The housing has a frame covering the periphery of the display portion when seen along a front-rear direction. The light-emitting portion comprises a light source for the light emitting-portion and a light-guiding member guiding the light of the light source for the light-emitting portion. The light-guiding member guides the light of the light source for the light-emitting portion to a front surface of the light-guiding member. The front surface of the light-guiding member is positioned so as to cover at least a front surface of the frame. The dynamic-image block and the light-source blocks are combined on a surface perpendicular to the front-rear direction. When seen along a front-rear direction, the length from the top end to the bottom end of each of the light-source blocks is the same as or n times or 1/n times (n being an integer) the length from the top end to the bottom end of the dynamic-image block, and the length from the left end to the right end of each of the light-source blocks is the same as or m times or 1/m times (m being an integer) the length from the left end to the right end of the dynamic-image block.

Advantageous Effects of Invention

Similarly to a block wall, the signboard device of the present invention is configured by combining the dynamic-image block and the light-source blocks. Therefore, the position of the dynamic-image block can be changed easily. The dynamic-image block is supported by the light-source blocks so that no support member supporting the dynamic-image block is needed. Therefore, the shadow of the support member doesn't fall on the front surface of the signboard. The light-guiding member is provided on the front surface of the frame of the LCD included in the dynamic-image block so that the shadow of the frame doesn't fall on a printed copy. Thus, the dynamic-image portion and the other portion are seen in more integrated manner. The signboard device of the present invention is configured by combining the dynamic-image block and the light-source blocks so that the shape of the signboard can be changed easily.

DESCRIPTION OF EMBODIMENTS

Figure 1:
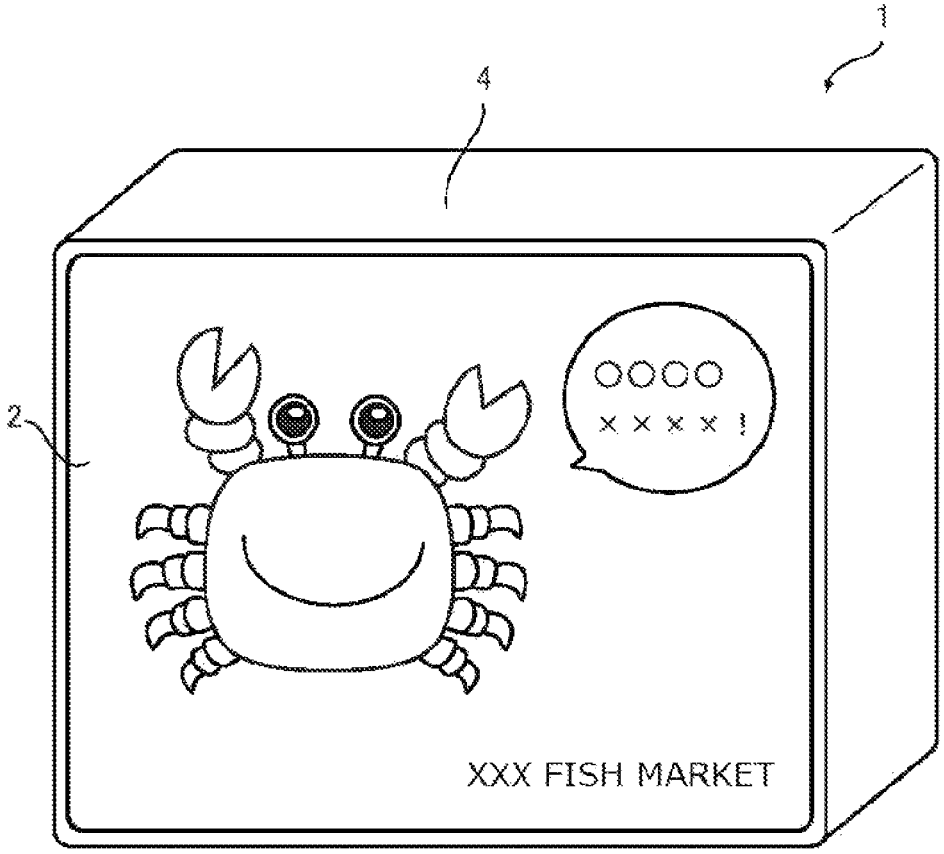
FIG. 1 is a view showing a signboard device according to an embodiment of the present invention.
Figure 2:
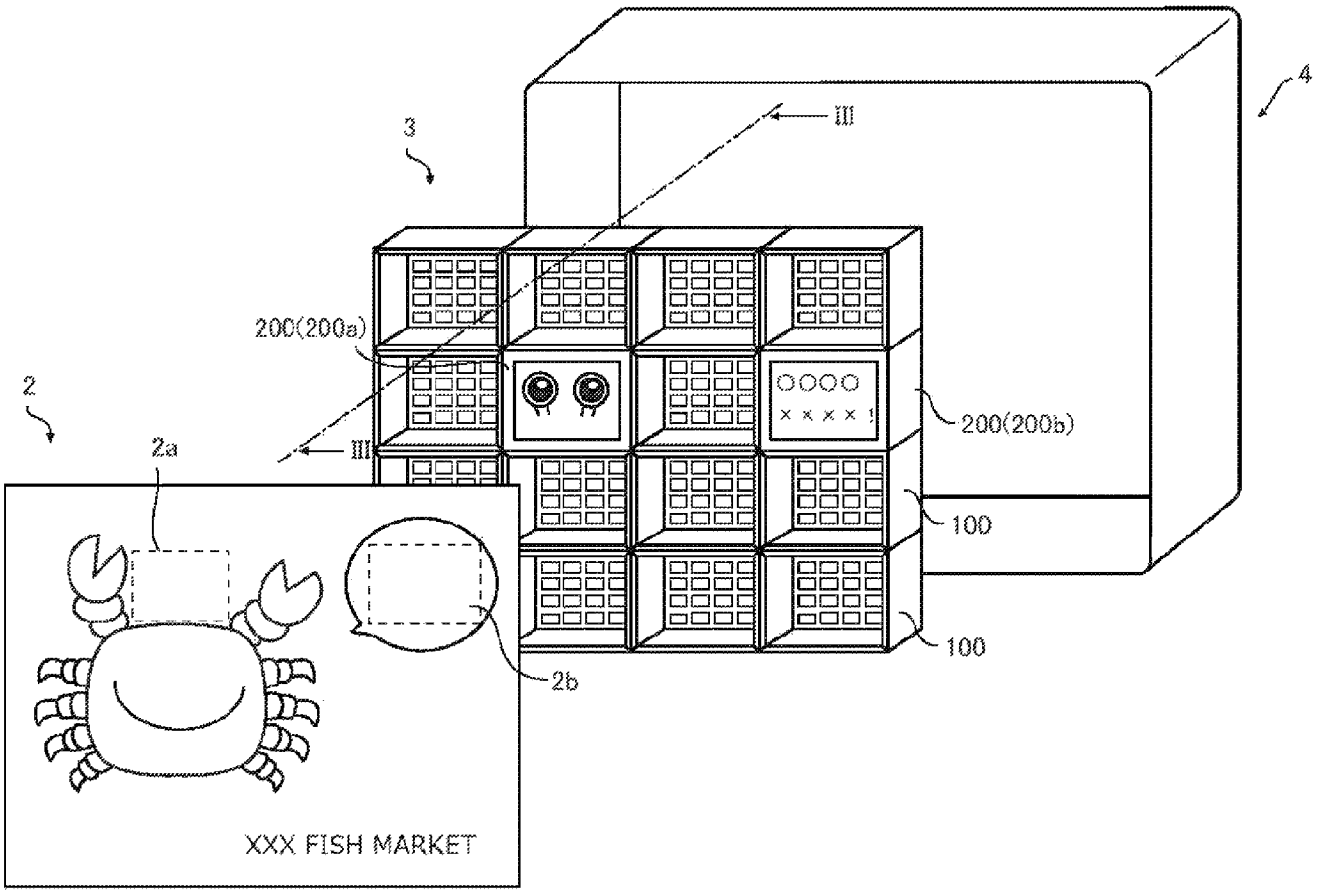
FIG. 2 is exploded oblique view showing the signboard device of FIG. 1.

As shown in FIG. 1 and FIG. 2, a signboard device 1 according to the embodiment of the present invention comprises a printed copy 2, a rear member 3 and a signboard housing 4. As understood from FIG. 2, the printed copy 2 is glued on the rear member 3. The rear member 3 with on which the printed copy 2 is glued is held by the signboard housing 4. The signboard housing 4 of the present invention is used for the prior signboard device.

The printed copy 2 is a sheet with an advertisement printed on it. The sheet is made of resin. A material or the thickness of the sheet may be changed as required. In the present embodiment, resin of PET (Polyethylene terephthalate) is used. Thus, the printed copy 2 can be recycled. The printed copy 2 of the present invention has transparent areas 2*a* and 2*b* indicated with a dotted line in FIG. 2. The transparent areas 2*a* and 2*b* are the areas, which are transparent and printed with no image.

As shown in FIG. 2, the rear member 3 is a combined member by laying a plurality of light-source blocks 100 and dynamic-image blocks 200 in an up-down direction and a right-left direction (i.e., on a surface perpendicular to a front-rear direction of the signboard device). In the present embodiment, the rear member 3 has fourteen light-source blocks 100 and two dynamic-image blocks 200 arranged in 4×4 matrix form. The light-source blocks 100 and the dynamic-image blocks 200 are combined so that a shape of the rear-member 3 is rectangle when seen along the front-rear direction. Therefore, the outer shape of the signboard device 1 appears to be rectangle. The number of the lines and the number of the rows is equal (4 lines and 4 rows), however, the rear-member 3 has the number of the lines and the number of the rows may be different.

Figure 3:
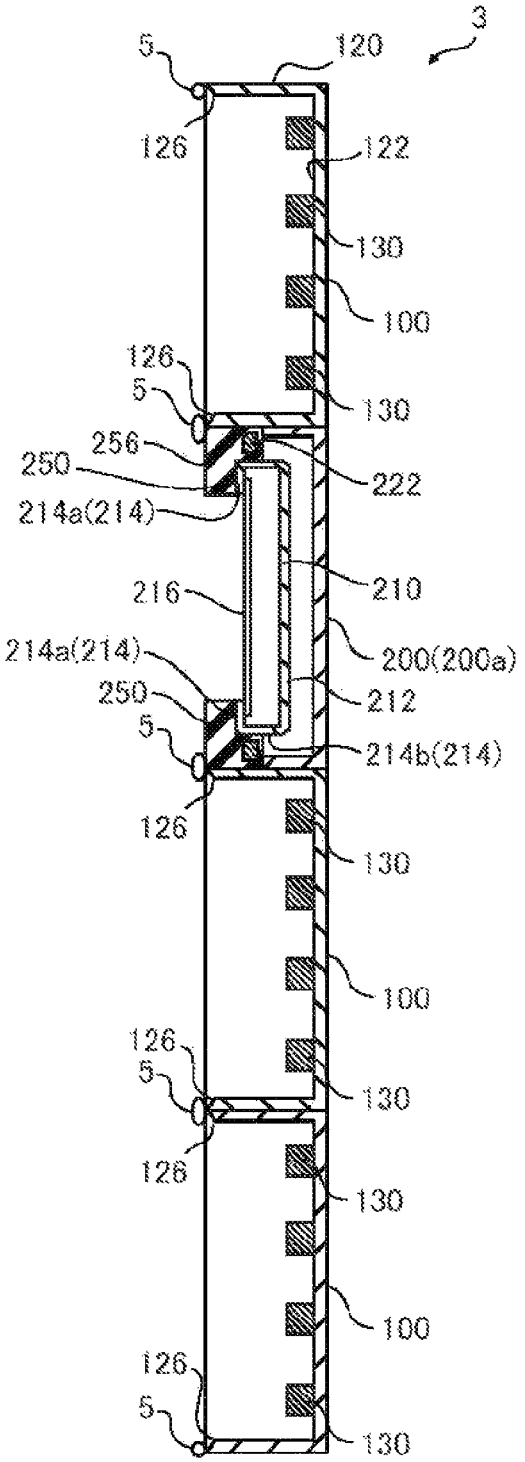
FIG. 3 is a cross-sectional view of a rear member, taken along lines III-III.
Figure 4:
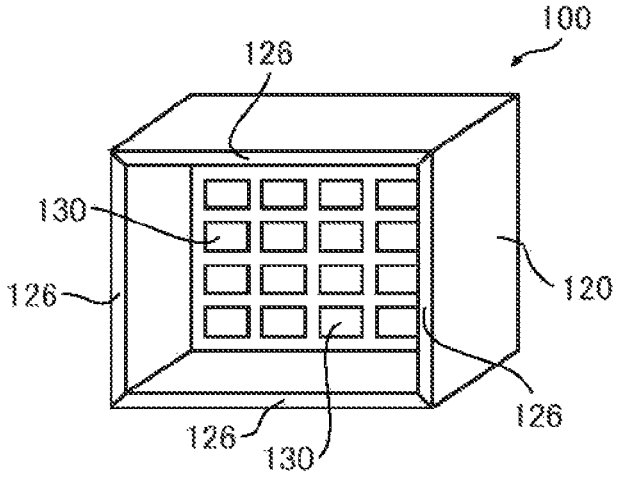
FIG. 4 is a view showing a light-source block used in the signboard device of FIG. 1.

As shown in FIG. 3 and FIG. 4, the light-source block 100 comprises a plurality of light sources 130 and a housing 120 which has a box-like shape whose front opens forward. The light sources 130 are provided on the innermost surface 122 which corresponds to the bottom of the housing 120 in the front-rear direction. The light-source block 100 is made of resin whose color is white or milky so that the light is further defused by the reflection effect of white. As understood from FIG. 3, the frontend portion (i.e. an end portion of an opening) is formed with a tapered portion 126. The tapered portion 126 is inclined inward of the housing 120. In other words, on the tapered portion 126, the outer side edge of the housing 120 is positioned forward than the inner side edged of the housing 120. With this structure, the light of the light source 130 is further defused as compared to using a housing provided with no tapered portion 126. The brightness of the light can be uniformed. The light-source 130 of the embodiment is LED (Light Emitting Diode), however, the light-source 130 is not limited thereto.

Figure 5:
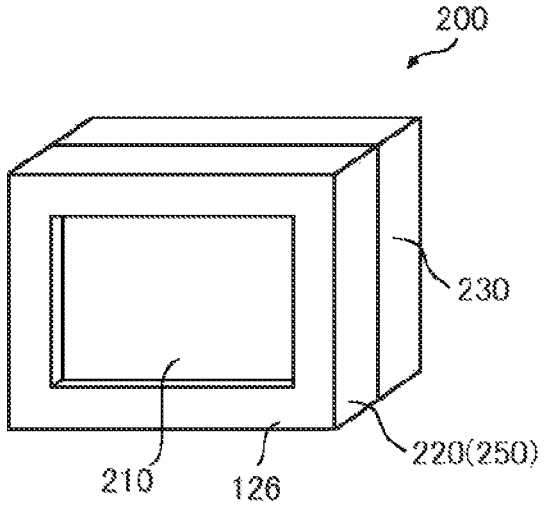
FIG. 5 is a view showing a dynamic-image block included in the signboard device of FIG. 1.
Figure 6:
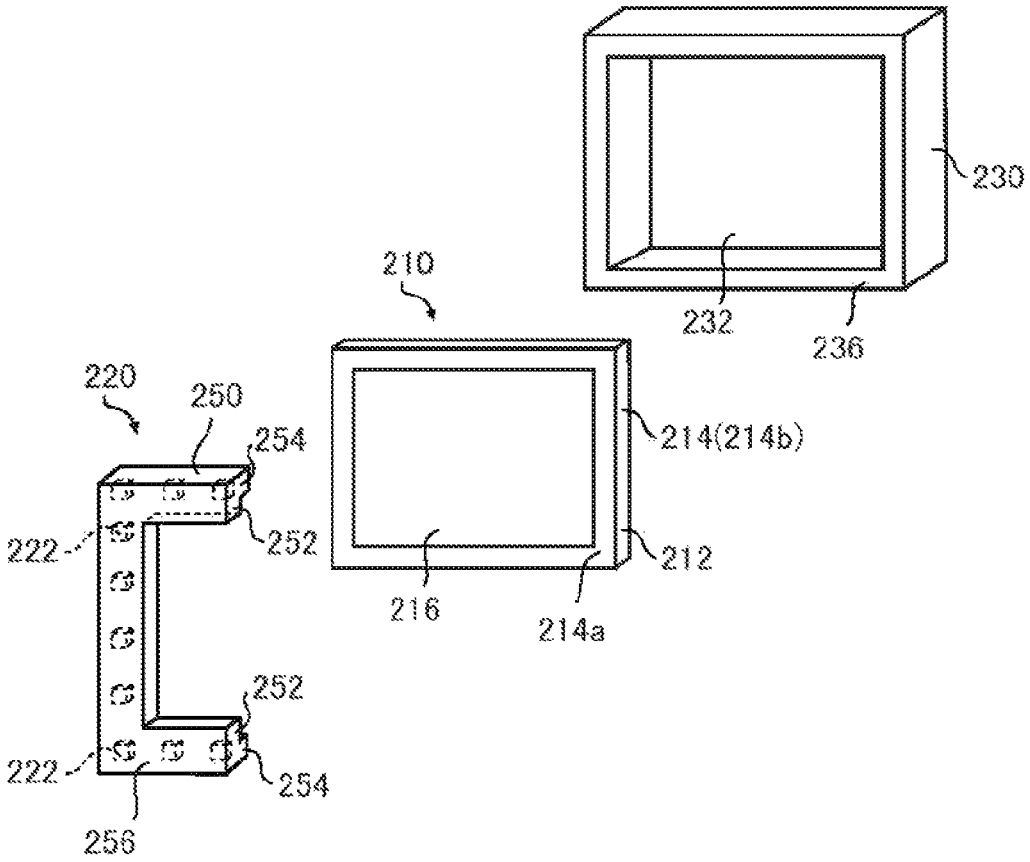
FIG. 6 is an exploded view of the dynamic-image block of FIG. 5. The light-emitting portion is shown in an oblique cross-sectional view to facilitate the understanding of the shape.

As shown in FIG. 3, FIG. 5 and FIG. 6, the dynamic-image block 200 comprises the an LCD (Liquid Crystal Display: a display device) 210, a light-emitting portion 220 and the housing 230. As understood from FIG. 6, the light-emitting portion 220, the LCD 210 and the housing 230 are arranged in this order from front in the dynamic-image block 200.

The LCD 210 of the embodiment is not specific but typical. In other words, as shown in FIG. 3 and FIG. 6, the LCD 210 has a LCP (liquid crystal panel: a display portion) 216 and a housing 212 holding the LCP 216. In this embodiment, a member constituted with a polarizing filter, a color filter and a liquid crystal layer as main components is called as "LCP". A member constituted with the LCP, a driving circuit, a backlight and a light guiding member as main components is called as "LCM (Liquid Crystal Module)". A combination of the LCM and the housing protecting thereof is called as "LCD". To facilitate the explanation the "LCP 216, "housing 212 (frame 214)" and "LCD 210" are specifically illustrated in the present drawings and the illustration and the explanation of other configuration are omitted. The housing 212 has a front frame 214 covering the periphery of the LCP 216 when seen from the front-rear direction of the signboard device 1. In this embodiment, the commercial LCD 210 (whose display size is standardized) is used so that the cost can be decreased (comparing to a case requiring to a manufacturing a specific size of the LCD). However, the present invention doesn't prevent from using the specific size of the LCD.

As shown in FIG. 3 and FIG. 6, the light-emitting portion 220 has an L shape in cross section on a surface defined by the front-rear direction and the up-down direction. In detail, the light-emitting portion 220 comprises a light source 222 for the light-emitting portion 220 and a light-guiding member 250 guiding light of the light source 222 for the light-emitting portion 220. The light-guiding member 250 comprises a cover potion 252 and a side portion 254. The cover portion 252 covers the front surface 214*a* of the frame 214 of the LCD 210. The side portion 254 extends rearward from the cover portion 252 so as to cover the side surface 214*b* of the frame 214. As shown in FIG. 3, the front surface 256 of the light-guiding member 250 covers the front surface 214*a* of the frame 214 entirely. In other words, the front surface 214*a* of the LCD 210 does not visible when the light-emitting portion 220 is attached. The light source 222 for the light-emitting portion 220 of the present embodiment is provided on the side portion 254 of the light-guiding member 250. A direction or an incident angle of the light source 222 for the light-emitting portion 220 can be changed as required.

In this embodiment, the light sources 222 for the light-emitting portion 220 are embedded in the side portion 254 of the light-guiding member 250. However, the light sources 222 may be separated from the light-guiding member 250. The light sources 222 of the light-emitting member 220 of the present embodiment are also LED, however, they are not limited thereto.

The light of the light source 222 for the light-emitting portion 220 is emitted from the front surface 256 through the light-guiding member 250. In other words, the light-guiding member 250 guides the light of the light source 222 to the front surface 256. The light-guiding member 250 has the L like shape in cross section, however the cross sectional shape of the light-guiding member 250 is not limited thereto. Any shape can be applied as long as the light of the light source 222 for the light-emitting portion 220 can be guided to the front surface 256. In order to emitting the light of the light-emitting portion 222 more uniformly, the shape of the light-guiding member 250 or the position or the direction of the light source 222 for the light-emitting 220 can be changed as required.

The housing 230 can be made from the housing 120 used to the above-mentioned light-source block 100. In detail, the housing 230 is made by cutting the housing 120 on the surface perpendicular to the front-rear direction (i.e. by minimizing the depth of the housing 120) so that a material cost can be reduced. The housing 230 has an inner surface 232 which has no light sources 130. The front end 236 is a section made by cutting the housing 120 of the light-source block 100. In this embodiment, the housing 212 is fixed with the LCD 210 so that the front end 236 is brought into contact with the housing 212 of the LCD 210. Therefore, the light-emitting portion 220, the LCD 210 and the housing 212 are integrated with each other.

As explained above, in this embodiment, the size of the light-source block 100 and the size of the dynamic-image block 200 are same when seen along the front-rear direction. In other words, the length from the top end to the bottom end of the light-source block 100 is the same as the length from the top end to the bottom end of the dynamic-image block, and the length from the left end to the right end of each of the light-source blocks is the same as the length from the left end to the right end of the dynamic-image block. As shown in FIG. 2, the outer shape of the signboard device 1 (the rear member 3) has a rectangular shape when seen along the front-rear direction.

The LCD 210 of the dynamic-image block is a 10.4-inch display. The LCD 210 is typically and commercially sold and is not made for specific use. The LCD 210 prescribes the size (i.e. the length from the top end to the bottom end and the length from the left end to the right end) of the dynamic-image block 200, and the size of the light-source block 100. The size of the light-source blocks is ¼ times the size of the dynamic-image block. In this case, the size of the combination of the four ¼ sized light-source blocks 100 can be the same as the size of the dynamic-image block 200. The position adjustment of the dynamic-image block 200 can be made in detail when the size of the light-source block 100 is minimizes than the size of the dynamic-image block 200.

The size of the light-source blocks is 4 times the size of the dynamic-image block. Thus, the one light-source block 100 can cover 4 times area. The aspect ratio may be difference. For example, the longitudinal length of the light-source block 100 is 2 times the longitudinal length of the dynamic-image block 200 and a lateral length of the length of the light-source block 100 is 4 times the lateral length of the dynamic-image block 200.

The length from the top end to the bottom end of each of the light-source blocks may be n times or 1/n times (n being an integer) the length from the top end to the bottom end of the dynamic-image block and the length from the left end to the right end of each of the light-source blocks may be m times or 1/m times (m being an integer) the length from the left end to the right end of the dynamic-image block as long as the signboard device 1 (the rear member 3) has the rectangular outer shape when seen along the front-rear direction. However, with considering the availability of the movement of dynamic-image block 200 and correspondence of variety design of the printed copy, it is preferred that the size of the light-source block 100 and the size of the dynamic-image block are same.

In the present embodiment, the printed copy 2 is glued to the rear member 3 with glue 5. The glue 5 are put on the tapered portion 126 of the light-source blocks 100 and the front surface 256 of the dynamic-image block 200. In this condition, the printed copy 2 and the rear member 3 are glued with each other by pushing the printed copy 2 to the rear member 3. In other words, there is the glue 5 between the printed copy 2 and the rear member 3 so that the printed copy 2 is not directly brought into contact with the rear member 3. Thus, the shadows of the tapered portion 126 of the light-source block 100 and the front surface 256 of the dynamic-image block 200 do not fall on the printed copy 2. In the present embodiment, the front of the dynamic-image block 200 (the front surface 256 of the light-guiding body 250) and the front of the plurality of the light-source blocks 100 (the front end of the tapered portion 126) are same in position in the front-rear direction. Thus, the printed copy 2 can be glued so as to make flat.

As shown in FIG. 2, the printed copy 2 has the transparent areas 2*a* corresponding to the dynamic-image block 200*a* and the transparent areas 2*b* corresponding to the dynamic-image block 200*b* when seen from the front. Thus, as shown in FIG. 1, "moving eyes" (the dynamic-image block 200*a*) and "changing sentence character (the dynamic-image block 200*b*) of a crab can be seen through the transparent area 200*a* and the transparent area 200*b*, respectively. As a result, "the crab having the moving eyes", "the moving character" and the still-picture (an illustration, words or the like illustrated on the printed copy 2) are seen in integral manner. As mentioned above, the frame 214 (housing 212) of the LCD 210 is generally made of the resin or the like. Therefore the frame 214 does not emit the light. If the light-emitting portion 220 were not used, the shadow of the frame 214 would fall on the printed copy 2. However, according to the present invention, (the front surface 256 of) the light-guiding member 250 covers the front surface 214*a* of the frame 214 so that the shadow of the frame 214 does not fall on the printed copy 2.

Figure 7:
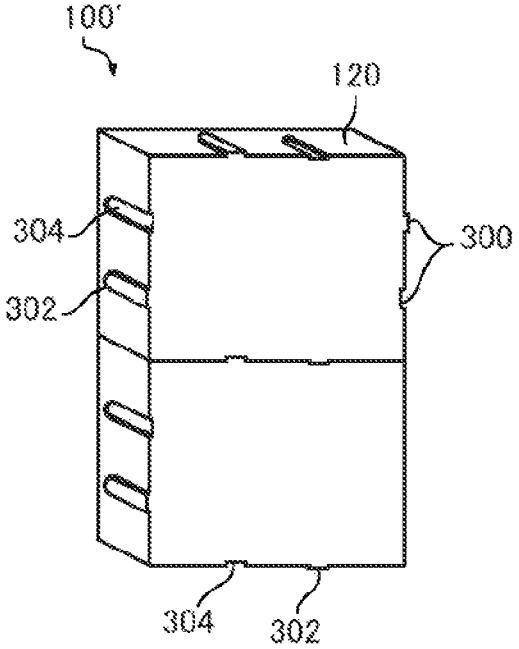
FIG. 7 is a schematic view showing a coupling member of the dynamic-image block and the light-source block.

The light-source blocks 100 and the dynamic-image blocks 200 may be coupled and fixed with each other by coupling means 300 shown in FIG. 7. Hereinafter, the term of "a block 100" means both the light-source block 100 and the dynamic-image block 200. The coupling means 300 comprises a protrusive portion 302 and a recessed portion 304. The coupling means are provided on four side surfaces positions of each of the blocks 100' so that the blocks 100' are coupled in the up-down and right-left direction. With this structure, the blocks 100' are fixed in the up-down and right-left direction (a Z-direction and an X-direction). In the present embodiment, coupling means 300 extends forward from the rear end of the block 100' and does not communicate with the front end. Therefore the block 100' can not pulled rearward. In other words, for example, the only one of the block 100' required to be removed can be pulled rearward when the block 100' is needed to be moved. Other blocks 100' do not fall down because the blocks 100' are coupled and fixed by the coupling means 300.

Figure 8:
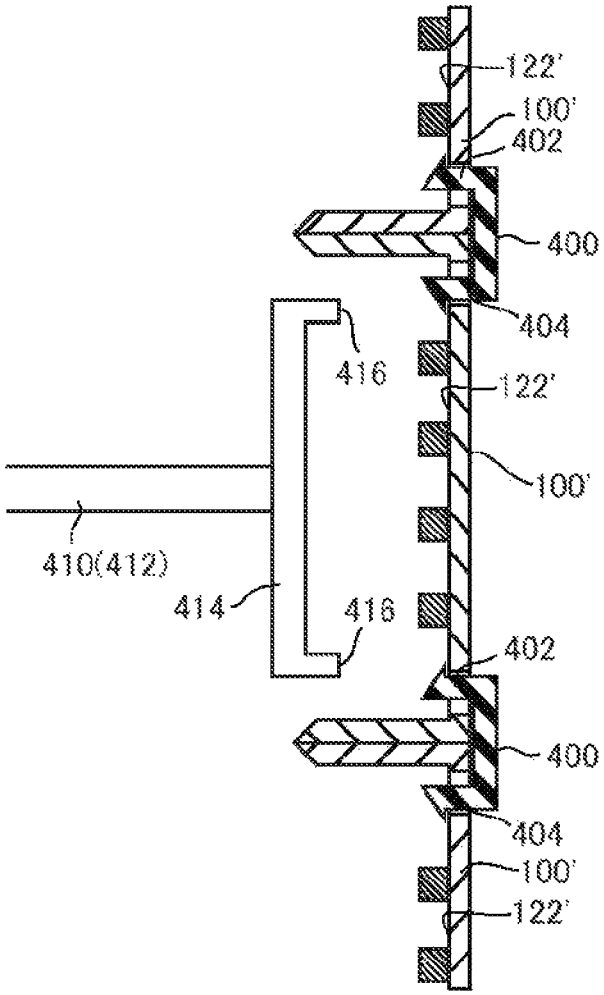
FIG. 8 is a view showing the dynamic-image block and the light-source block the coupling of which is fixed by the fixing member and showing a jig which releases the fixing by the fixing member.

As mentioned above, the printed copy 2 and the rear member 3 is glued and fixed by glue 5. However, a fixing member 400 shown in FIG. 8 may be provided between the blocks 100' in case some blocks 100' slip forward unintentionally. The fixing member 400 has a cramp-like shape having an upper engagement portion 402 and the lower engagement portion 404. Each of the upper engage portion 402 and the lower engage portion 404 has "a claw" protruding outward. As understood from FIG. 8, the fixing member 400 is inserted through the opening formed on the inner surface 122' of the block 100'. Each of the upper engagement portion 402 and the lower engagement portion 404 engages with the block 100' so that the block 100' can not be pulled forward. Therefore, when using the coupling means 300 and the fixing member 400, the block 100' can be prevented from moving or sliding in the front-rear direction, the right left direction and the up down direction. The fixing member 400 can be released by a jig 410 having a T-like shape as illustrated in FIG. 8. The jig 400 has a handle 412 corresponding the vertical line in T shape and a releasing portion 414 corresponding a horizontal line in T shape. Pushing portions 416 are provided both ends of the releasing portion 414 protruding therefrom. As understood from FIG. 8, the pushing portions 416 of the jig 410 can push the upper engagement portion 402 and the lower engagement portion 404. The pushed upper engagement portion 402 and the pushed lower engagement portion 404 are deformed inward. The size of the opening provided on the inner surface 122' of the block 100' is larger than the size of the upper engagement portion 402 and the lower engagement portion 404, both included with the claws, in the up-down direction. Therefore, the pushed upper engagement portion 402 and lower engagement portion 404 can be moved rearward and removed. In this state, when pulling the block 100' forward, the block 100' can be pulled out.

Figure 9:
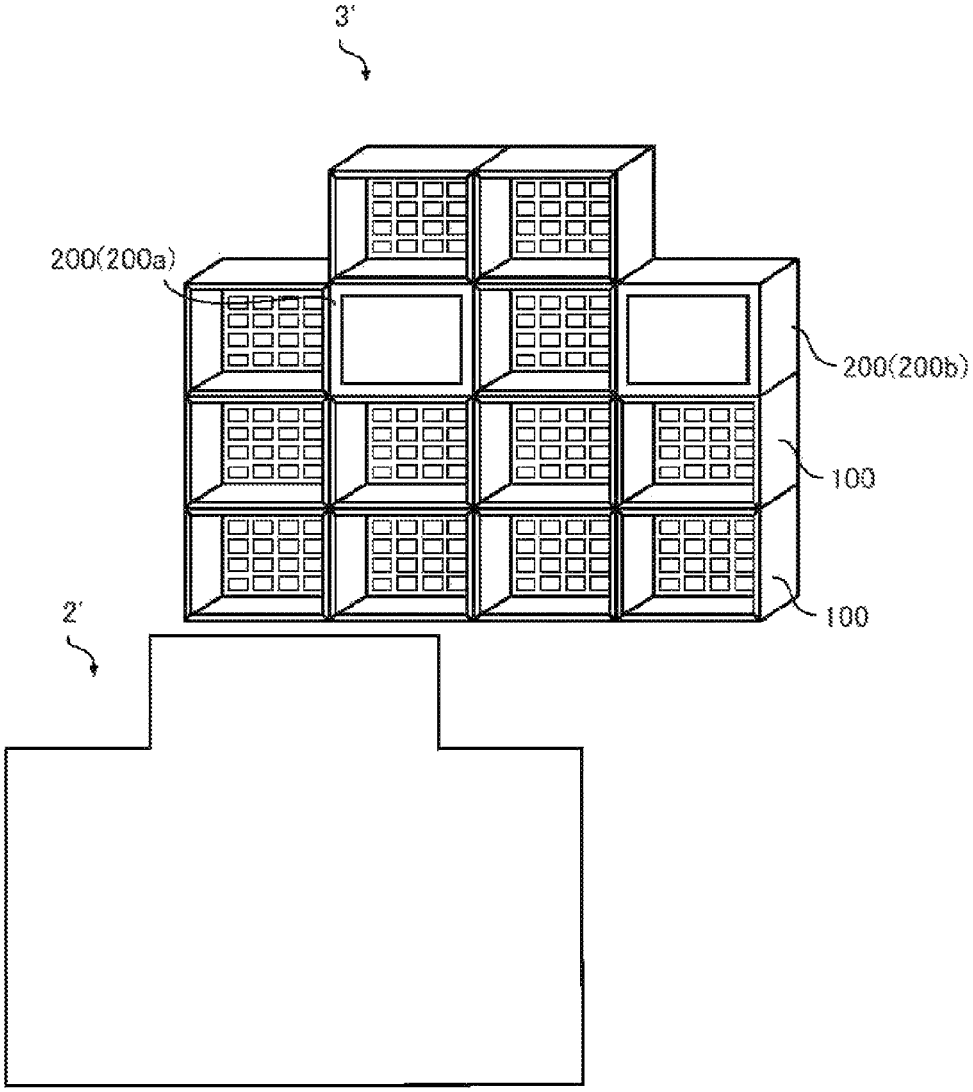
FIG. 9 is an exploded view showing a variation example of the signboard device of FIG. 2.

The rear member 3 illustrated in FIG. 2 has the rectangular shape. However, depending on a shape of the printed copy 2 (i.e. a shape of the signboard device), the rear member may have another shape such as, for example, shown in FIG. 9. The printed copy 2' shown in FIG. 9 has a shape whose parts of upper right and upper left are removed. Accordingly, the uppermost of the right end and the left end of the light source blocks 100 are removed. Alternatively, the rear member 3 shown in FIG. 2 may be attached with one or more of the light-source block 100. In this case, the rear member 3 has a rectangular shape having a convex portion. The rear member 3 may have both the convex portion and the recessed portion depending on the shape of the printed copy or the location (a shape of a attaching space or the like) of the signboard device.

According to the rear member 3 of the present invention, the light-source blocks and the dynamic-image blocks can be combined freely. Therefore, the printed copy whose shape is not rectangular can be applied.

What is claimed is:

1. A signboard device comprising: a plurality of light-source blocks each provided with a light source emitting light forward, and a dynamic-image block comprising a display device and a light-emitting portion, the display device comprising a display portion and a housing holding the display portion, the display portion displaying a dynamic image, the housing comprising a frame covering the periphery of the display portion when seen along a front-rear direction, the light-emitting portion comprising a light source for the light emitting-portion and a light-guiding member guiding the light of the light source for the light-emitting portion, the light-guiding member guiding the light of the light source for the light-emitting portion to a front surface of the light-guiding member, the front surface of the light-guiding member being positioned so as to cover at least a front surface of the frame, wherein the dynamic-image block and the light-source blocks are combined on a surface perpendicular to the front-rear direction, when seen along the front-rear direction, a length from a top end to a bottom end of each of the light-source blocks is the same as or n times or 1/n times (n being an integer) a length from a top end to a bottom end of the dynamic-image block, and a length from a left end to a right end of each of the light-source blocks is the same as or m times or 1/m times (m being an integer) the length from a left end to a right end of the dynamic-image block.

2. The signboard device recited in claim 1, wherein a size of the light-source block and a size of the dynamic-image block are same when seen along the front-rear direction.

3. The signboard device recited in claim 2, wherein a shape of the signboard device is rectangle when seen along the front-rear direction.

4. The signboard device recited in claim 3, wherein a position of a front end of the dynamic image block and a position of a front end of the light-source blocks are same in the front-rear direction.

* * * * *